US008579550B2

(12) United States Patent
Feyrer et al.

(10) Patent No.: US 8,579,550 B2
(45) Date of Patent: Nov. 12, 2013

(54) TRUSS SHOE FOR USE WITH A THREADED ROD

(71) Applicant: FCI Holdings Delaware, Inc., Wilmington, DE (US)

(72) Inventors: John Feyrer, Sewickley, PA (US); Travis Mikel Sub, Butler, PA (US); John C. Stankus, Canonsburg, PA (US); John G. Oldsen, Butler, PA (US); Demrey G. Brandon, Pittsburgh, PA (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 0 days.

(21) Appl. No.: 13/735,264

(22) Filed: Jan. 7, 2013

(65) Prior Publication Data

US 2013/0183105 A1 Jul. 18, 2013

Related U.S. Application Data

(60) Provisional application No. 61/585,850, filed on Jan. 12, 2012.

(51) Int. Cl.
*E21D 21/00* (2006.01)

(52) U.S. Cl.
USPC ..... 405/302.1; 405/288; 299/11

(58) Field of Classification Search
USPC ..... 405/259.1, 288, 302.1, 302.2, 302.3; 299/11
See application file for complete search history.

(56) References Cited

U.S. PATENT DOCUMENTS

| | | | | |
|---|---|---|---|---|
| 4,395,161 | A * | 7/1983 | Wilson et al. | 405/302.1 |
| 5,466,095 | A * | 11/1995 | Scott | 405/302.2 |
| 5,544,982 | A * | 8/1996 | Seegmiller | 405/288 |
| 6,884,005 | B1 * | 4/2005 | Seegmiller | 405/288 |
| 7,118,310 | B2 * | 10/2006 | Wallstein et al. | 405/288 |
| 7,261,494 | B2 * | 8/2007 | Stankus et al. | 405/288 |
| 7,717,650 | B2 * | 5/2010 | Reschke et al. | 405/302.1 |
| 8,057,128 | B2 * | 11/2011 | Stankus et al. | 405/302.2 |
| 2005/0201837 | A1 * | 9/2005 | Stankus et al. | 405/288 |

* cited by examiner

*Primary Examiner* — Frederick L Lagman
(74) *Attorney, Agent, or Firm* — The Webb Law Firm

(57) ABSTRACT

A truss shoe for a roof support system includes a bolt receiving section, an intermediate section, and a housing having a threaded rod engaging section. The threaded rod engaging section has a passageway having a first open end spaced from, and in facing relationship to, the bolt receiving section and an opposite second end. The passageway has a threaded portion extending from the first end of the passageway toward the second end. A stop member is positioned spaced from the first open end of the passageway. With this arrangement, the end of the threaded rod passes through the space between the first open end of the passageway and the stop member into engagement with the stop member, whereby all of the threads of the threaded portion of the passageway are in engagement with the threads of the threaded bar.

11 Claims, 7 Drawing Sheets

TRUSS SHOE FOR USE WITH A THREADED ROD

BACKGROUND OF THE INVENTION

1. Field of the Invention

This invention relates to a truss shoe for use with a threaded rod and, more particularly, to a truss shoe having a threaded passageway to receive an end portion of the threaded rod; the truss shoe having a stop member spaced from an exit end of the threaded passageway to pass the end of the threaded rod past the exit end of the passageway for full thread engagement of the threaded passageway.

2. Discussion of the Presently Available Technology

Truss-type mine roof supports are well known in the art of supporting the roof of an underground passageway, such as a mine passage. A basic truss system includes one or more threaded rods extending horizontally the width of the mine passage adjacent the roof and connected at their ends to anchor bolts, which extend at an angle adjacent the ribs of the passage into the rock strata over a solid pillar. The rods are tensioned and vertical components of compressive forces are transmitted into the rock strata over the solid pillars, as opposed to the unsupported rock strata immediately above the passage.

With this arrangement, a truss system shifts the weight of the rock strata from over the mined-out passage back onto the pillars. Conventionally, holes are drilled into the mine roof at a 45° angle from the horizontal adjacent to the mine rib so that the holes extend into the supported rock strata over a pillar.

Once the holes are drilled at an angle into the strata over the pillars at the rib line, anchor bolts are inserted into the drilled holes and are secured in place using mechanical expansion shell assemblies and/or a resin made from a mixture of a resin component and an epoxy component. Before the bolts are inserted in the drilled holes, truss shoes are positioned on the bolt at the emergent end of the bolt from the hole. As the bolts are securely anchored in the drilled holes, the bearing surfaces of the truss shoes are compressed into engagement with the mine roof.

For an uneven mine roof or a roof having severely potted areas, the truss shoe preferably has sufficient bearing surface to contact the mine roof so that the truss shoe is correctly positioned for engagement with the horizontal truss members. Once the truss shoes are securely positioned at the mine roof adjacent the ribs, the horizontal truss members are assembled and connected to the truss shoes. Horizontal truss members are tightened to a predetermined tensioning load so that the weight of the rock strata over the mined-out area beneath the roof can shift along the horizontal truss members upwardly into the solid rock strata over the pillars at the rib line.

The truss hardware is connected under tension to the truss shoes that are held tightly against the mine roof by the anchored angle bolts. A wide variety of truss hardware is commercially available to form a truss system between the anchored angle bolts. For example and not limiting to the discussion, U.S. Pat. No. 7,261,494 (hereinafter also referred to as "USPN '494") and U.S. Pat. No. 8,057,128 (hereinafter also referred to as "USPN '128"), both of which are assigned to FCI Holdings Delaware, Inc., disclose a cable truss system including a pair of truss shoes, a pair of inclined bolts, and a truss assembly. In general, the truss shoes of USPNs '494 and '128 include a bolt receiving end portion to receive the bolt that attaches the truss shoe to the ceiling or roof, and an opposite cable receiving and retaining end portion to receive an end of a cable to secure the cable to the truss shoe. The cable receiving and retaining end portion includes a tapered passageway for receiving a wedge or cone-shaped retention assembly.

The retention assembly is secured in the passageway by a washer (USPN '494) or a locking tube (USPN '128). The truss shoes of USPNs '494 and '128 are acceptable for use with truss systems that connect the truss shoes with cables, but, as can be appreciated by those skilled in the art, they are not used with truss systems that interconnect the truss shoes with threaded rods.

Truss shoes are available for use with truss systems connecting the truss shoes with threaded rods; however, the truss shoes that are interconnected by threaded bars have limitations. By way of illustration and not limited thereto, a stop member is provided at the exit end of a threaded passageway of the truss shoe. The stop member prevents the end of the threaded rod from passing through the threaded passageway, thereby preventing the threaded passageway of the truss shoe from being fully threaded on the threaded rod.

As can be appreciated by those skilled in the art, it would be advantageous to provide a truss shoe designed to permit a threaded rod to pass through the exit end of a threaded passageway of the truss shoe to provide full thread engagement of the threaded passageway by the threaded rod.

SUMMARY OF THE INVENTION

This invention relates to a method of securing a threaded rod in a truss shoe of a mine roof support assembly by, among other things, providing a truss shoe including, among other things, a one-piece body member having a base member having a bearing surface, an opposite surface having a bolt receiving section, a housing spaced from the bolt receiving section, and a stop member; the bolt receiving section having a retention hole; the housing having a passageway, the passageway having a first open end facing the bolt receiving section, an opposite second open end, and a threaded portion extending from the first open end of the passageway toward the second open end, and the stop member positioned between the bolt receiving section and the housing, and spaced from the first open end of the passageway. The threaded rod is moved through the second open end of the passageway to move the first end of the threaded rod through the threaded portion of the passageway, out of the first open end of the passageway and through the space between the first open end of the passageway and the stop member into engagement with the stop member, wherein all of the threads of the threaded portion of the passageway are in facing relationship to the threads of the threaded bar.

Further, this invention relates to a truss shoe for use in a mine roof support system, the truss shoe includes, among other things, a one-piece body member including, among other things, a base member having a bearing surface; an opposite surface having a bolt receiving section, the bolt receiving section having a retention hole; a housing spaced from the bolt receiving section, the housing having a passageway, the passageway having a first open end facing the bolt receiving section, an opposite second open end, and a threaded portion extending from the first open end of the passageway toward the second open end, and a stop member, the stop member positioned between the bolt receiving section and the housing, and spaced from the first open end of the passageway, whereby moving the threaded rod through the second open end of the passageway moves the first end of the threaded rod through the threaded portion of the passageway, out of the first open end of the passageway and through the space between the first open end of the passageway and the stop member into engagement with the stop member.

DESCRIPTION OF THE PREFERRED EMBODIMENTS

Figure 1:
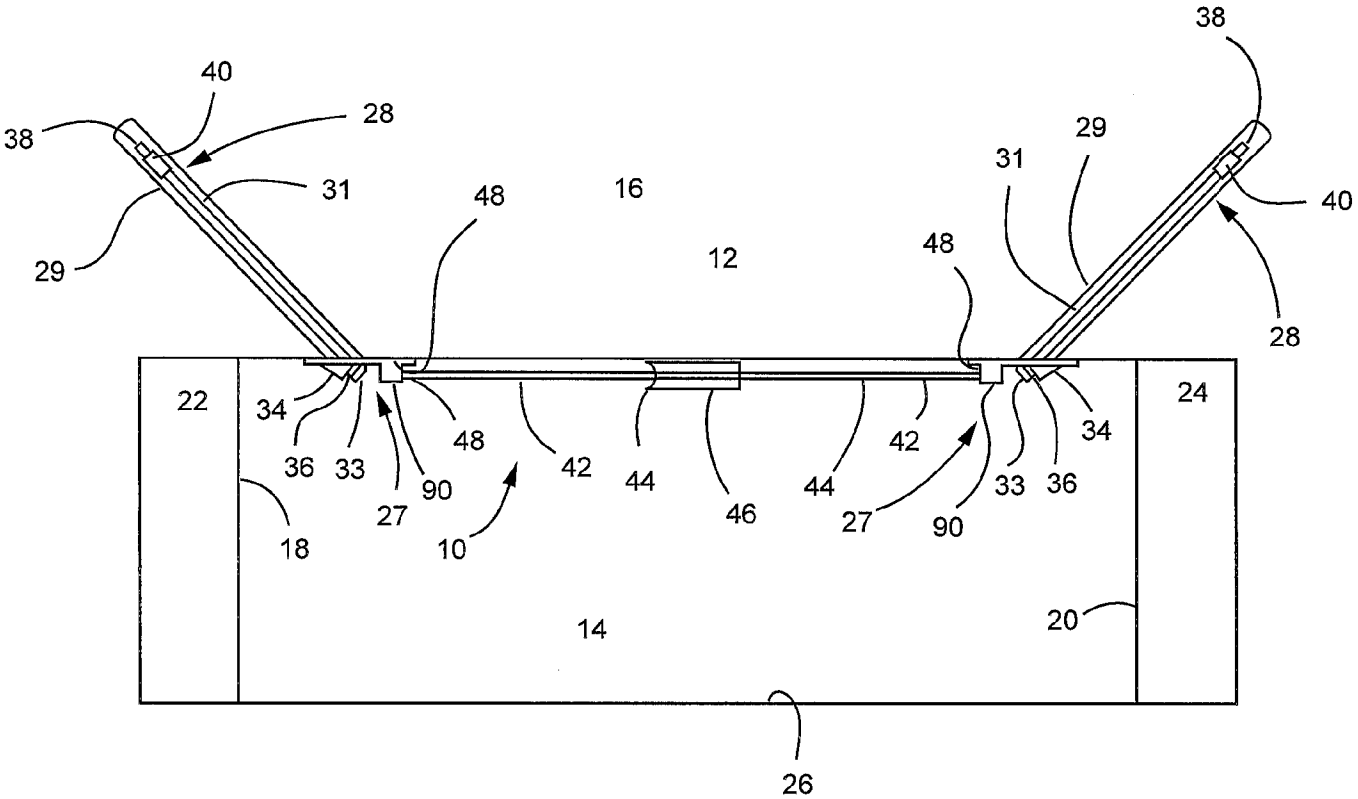
FIG. 1 is a side sectional view of an underground passage having a truss system installed according to the present invention.

A complete understanding of the invention will be obtained from the following description when taken in connection with the accompanying drawing figures, wherein, unless indicated otherwise, like reference characters identify like parts throughout. Further, the terminology used herein to discuss the non-limiting embodiments of the invention is for purposes of description and not of limitation.

For purposes of the description hereinafter, the terms "upper", "lower", "right", "left", "vertical", "horizontal", "top", "bottom", "lateral", and derivatives thereof, shall relate to the invention as it is oriented in the drawing figures. However, it is to be understood that the invention can assume various alternative variations and step sequences, except where expressly specified to the contrary. It is also to be understood that the specific devices and processes illustrated in the attached drawings, and described in the following specification, are simply exemplary non-limiting embodiments of the invention. Hence, specific dimensions and other physical characteristics related to the embodiments disclosed herein are not to be considered as limiting. Further, all numbers expressing dimensions, physical characteristics, and so forth used in the specification and claims are to be understood as being modified in all instances by the term "about". Accordingly, unless indicated to the contrary, the numerical values set forth in the following specification and claims can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between, and inclusive of, the minimum value of 1 and the maximum value of 10; that is, all subranges beginning with a minimum value of 1 or more and ending with a maximum value of 10 or less, e.g., 1 to 6.7, or 3.2 to 8.1, or 5.5 to 10.

Referring to FIG. 1, there is illustrated a truss system 10 for supporting a roof 12 above an underground passage or passageway 14 cut in a rock formation 16 by conventional mining methods to extract solid material, such as coal, in a mining operation. The passageway 14 is defined by the roof 12, oppositely positioned side walls 18 and 20 formed by ribs or pillars 22, 24, respectively, that extend between the roof 12, and a floor 26. The portion of the rock formation 16 above the roof 12 and between the pillars 22, 24 is unsupported. The truss system 10 incorporating a truss shoe 27 of the invention (see FIG. 2) is installed transversely across the passageway 14 adjacent the roof 12 to provide an uplifting force through the unsupported roof 12 in a manner which is well known in the art by which the weight of the rock formation 16 above the roof 12 is shifted horizontally and redirected to the rock formation 16 supported by the pillars 22 and 24.

As is appreciated, the truss system incorporating features of the invention is not limited to providing an uplifting force to the roof 12 of the passageway 14 and can be used to apply a supporting force to the sidewalls 18 and 20.

With continued reference to FIG. 1, the truss system 10 is secured to the mine roof 12 by elongated roof bolt assemblies 28 inserted in bore holes 29 drilled at an angle through the surface of the roof 12 for a predetermined length into the rock formation 16, which is supported by the solid pillars or ribs 22 and 24. In one non-limiting embodiment of the invention, the bore holes 29 are drilled at a 45° angle for a distance of six feet (1.8 meters) or greater into the rock formation 16 spaced within two feet (0.6 meters) from the respective side walls 18 and 20 to end points supported by solid material above the pillars 22 and 24.

One non-limiting roof bolt assembly, e.g., roof bolt assembly 28, that can be used in the practice of the invention and not limiting the invention thereto, includes an elongated roof bolt, e.g., elongated roof bolt 31, having an enlarged head, e.g., nut 33, at one end portion 34, a washer 36 between the enlarged head 33 of the roof bolt 31 and the truss shoe 27, and an opposite threaded end portion 38. A mechanical expansion shell assembly 40 is threadably engaged to the threaded end portion 38 of the bolt 31. As is well known in the art, upon rotation of the roof bolt 31, the shell assembly 40 is expanded into gripping engagement with the wall of the bore hole 29 to exert tension on the elongated roof bolt 31, with the end portion 34 of the bolt 31 bearing against the mine roof 12. To increase the anchorage of the elongated roof bolt 31 of the roof bolt assembly 28 within the bore hole 29, resin can be used in combination with the roof bolt assembly 28 when it is installed, e.g. but not limiting to the invention, as disclosed in U.S. Pat. No. 6,619,888 (hereinafter also referred to as "USPN '888"), incorporated by reference. The use of resin adds additional strength to the anchorage of the roof bolt 31 of the roof bolt assembly 28 in its respective one of the bore holes 29 when torque is applied to the end portion 34 of the roof bolt 31.

With continued reference to FIG. 1, the truss system 10 further includes threaded rods or bars 42 that extend horizontally between the pair of truss shoes 27 of the invention. One end 44 of each of the bars 42 is joined by a coupler or splice tube 46 of the type used in the art, and other end 48 of the bar 42 is joined to the truss shoe 27 in accordance to the teachings of the invention.

Figure 2:
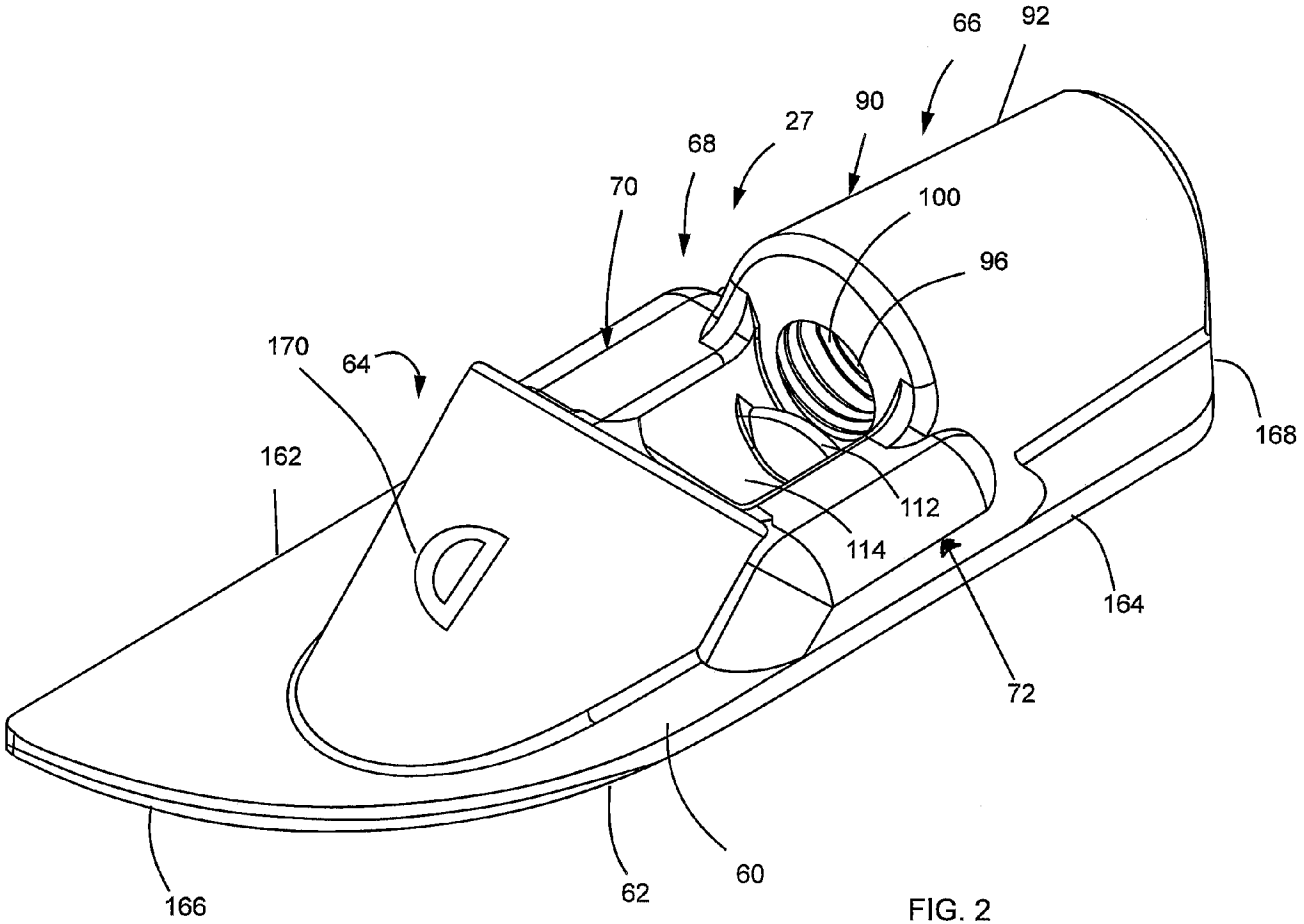
FIG. 2 is an orthogonal view of a non-limiting embodiment of a truss shoe according to the present invention.
Figure 3:
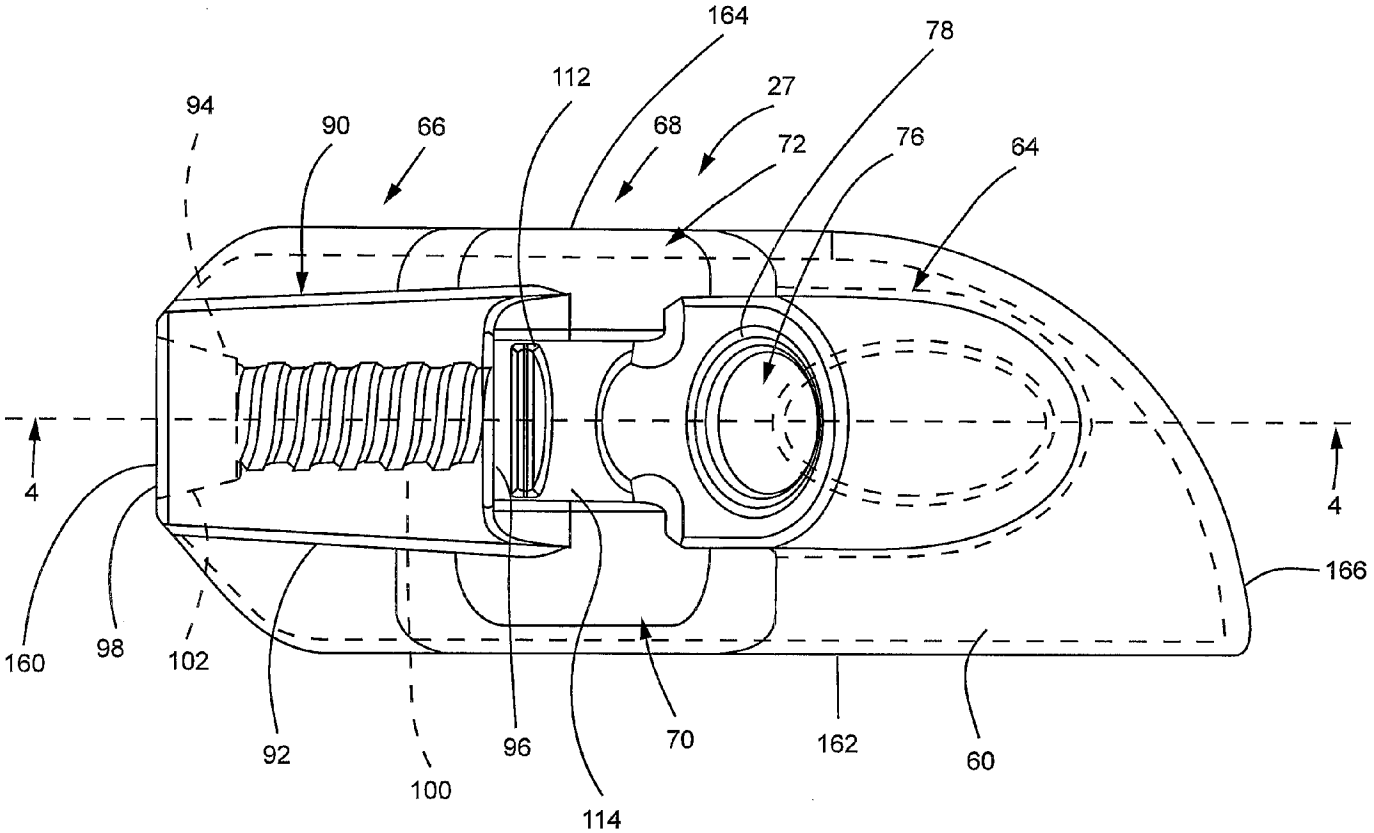
FIG. 3 is plane view of the truss shoe shown in FIG. 2.
Figure 4:
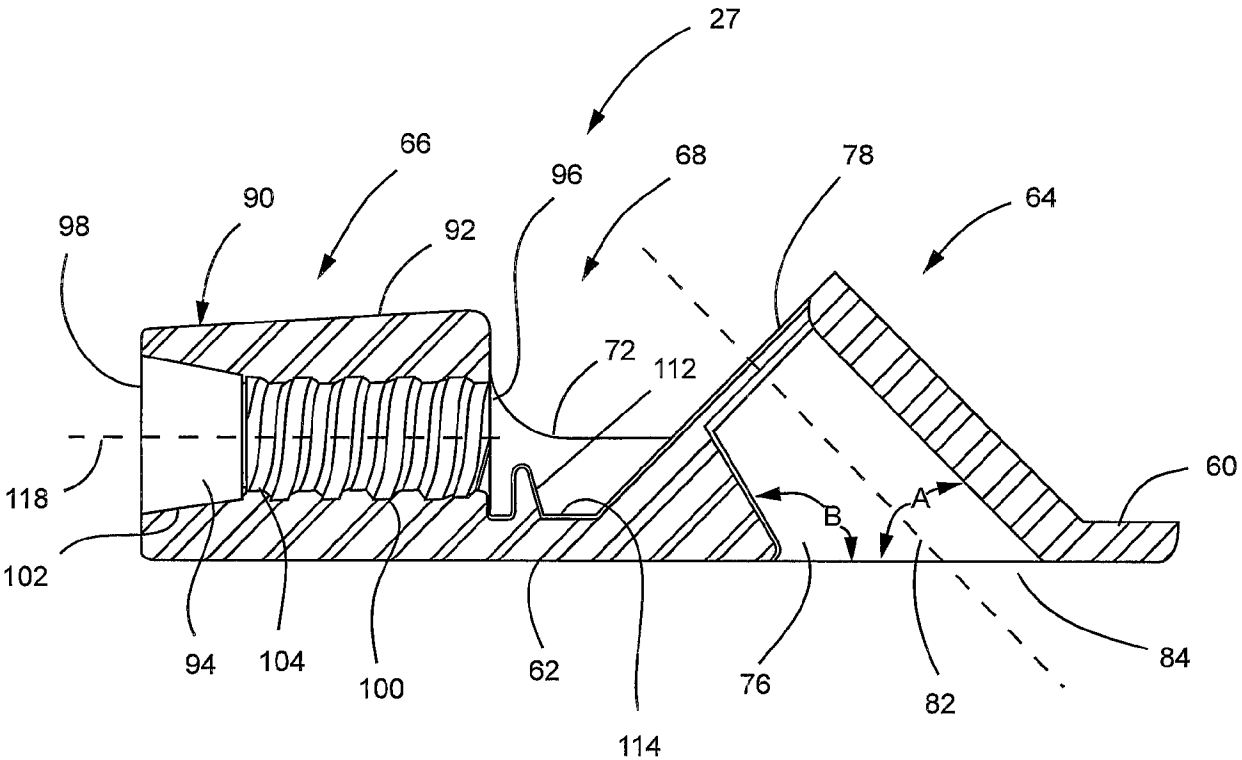
FIG. 4 is a view taken along lines 4-4 of FIG. 3.

With reference to FIGS. 2-4, as needed, in one non-limiting embodiment of the invention, the truss shoe 27 includes a base 60 having bearing surface 62 (see FIGS. 2 and 4), a bolt receiving section 64 extending upward from the base 60, a threaded rod receiving or engaging section 66 also extending upwardly from the base 60 and in spaced relation to the bolt receiving section 64, and an intermediate body section 68 extending from the bolt receiving section 64 to the rod engaging section 66. The intermediate body section 68 includes a pair of spaced side ribs or gussets 70 and 72 extending from the bolt receiving section 64 to the rod engaging section 66. Each one of the side ribs 70 and 72 extends upwardly or outwardly from the base 60 and are connected at one end portion to the bolt receiving section 64 and at the opposite end portion to the cable engaging section 66. The side ribs 70 and 72 provide structural stability to the truss shoe 27, for example and not limiting to the invention, to prevent bending of the truss shoe 27 at a position between the bolt receiving section 64 and the threaded rod engaging section 66.

The invention is not limited to the shape or the dimensions of the side ribs 70 and 72, however, the side ribs 70 and 72 should be sized to provide structural stability to the truss shoe 27, for example and not limiting to the invention, to prevent bending of the truss shoe 27 at a position between the bolt receiving section 64 and the threaded rod receiving or engaging section 66 (see FIGS. 2 and 3). As is appreciated, the invention can be practiced using any of the types of side ribs known in the art.

Prior to installation of the elongated roof bolt assembly 28 in the bore hole 29 in the rock formation 16, the end portion 38 of the roof bolt 31 is moved through a bolt retention hole 76 in the bolt receiving section 64 of the truss shoe 27, with the enlarged head 33 of the roof bolt 31 and the washer 36 engaging an open end 78 of the bolt retention hole 76 of the truss shoe 27. The expansion shell assembly 40 can be threaded onto the threaded end portion 38 of the roof bolt 31 before the roof bolt 31 is moved through the retention hole 76 of the truss shoe 27, or after the roof bolt 31 is moved through the retention hole 76 of the truss shoe 27. The roof bolt 31 having the expansion shell assembly 40 is then inserted upwardly into the angled bore hole 29 in the rock formation 16. The roof bolt assembly 28 is advanced into the bore hole 29 so that the enlarged head 33 of the bolt 31 moves the washer 36 against the open end 78 of the retention hole 76 of the truss shoe 27 to urge the bearing surface 62 of the truss shoe 27 (see FIGS. 1, 2, and 4) into contact with the roof 12. When the bearing surface 62 of the truss shoe 27 is satisfactorily seated in contact with the roof 12, a torque is applied to the end portion 34 of the roof bolt 31 to expand the shell assembly 40 to anchor the roof bolt assembly 28 in its respective one of the bore holes 29 in the roof 12.

As can be appreciated, the invention is not limited to the manner in which the truss shoe of the invention is secured against the roof 12 of the passageway 14 (see FIG. 1). For example and not limiting to the invention, the techniques disclosed in USPN '888 can be used to set a bolt in each of the bore holes 29 in the rock formation 16. After the bolt is set in the rock formation, the retention hole 76 of the truss shoe 27 is passed over the threaded end of the bolt extending out of the bore hole 29 to bias the bearing surface 62 of the truss shoe 27 against the roof 12, after which a nut is threaded onto the threaded end of the bolt to secure the bearing surface 62 of the truss shoe 27 against the roof 12 of the passageway 14.

With continued reference to FIGS. 1-4 as needed, the discussion is directed to the retention hole 76 in bolt receiving section 64 of the truss shoe 27. As is appreciated by those skilled in the art and as discussed above, the bore holes 29 are drilled into the rock formation 16 at an angle so that threaded end portion 38 of the roof bolt 31 extends over a pillar, e.g., one of the pillars 22 and 24, and the end portion 34 of the bolt 31 extends out of the roof 12 of the passageway 14. To provide for full surface contact and/or to maximize surface contact between bearing surface 62 of the truss shoe 27 and the roof 12 of the passageway 14 (see FIG. 1), centerline 82 (see FIG. 4) of the retention hole 76 of the truss shoe 27 is normal to a plane containing the open end 78 of the retention hole 76 and subtends an angle "A" to the bearing surface 62 of the truss shoe 27 that is the same as, or similar to, the angle subtended by center line of the bore hole 29 in the rock formation 16 and the plane of the roof 12. Although not limiting to the invention, the angle is usually 45°.

With continued reference to FIG. 4, an open end 84 of the retention hole 76 at the bearing surface 62 of the truss shoe 27 has an enlarged opening for ease of inserting the roof bolt 31 or the roof bolt assembly 28 into the bore hole 29 in the rock formation 16. For example and not limiting to the invention, the open end 84 of the retention hole 76 at the bearing surface 62 of the truss shoe 27 has a diameter of 1.75 inches (4.45 centimeters); the diameter decreases for a distance of 0.188 inch (0.48 centimeter) to a diameter of 1.375 inches (3.49 centimeters) at the open end 78 of the retention hole 76 of the truss shoe 27. The shape of the retention hole 76 as it extends toward the bearing surface 62 of the truss shoe 27 changes from a circular configuration at the open end 78 to an elliptical configuration at the open end 84 so that the roof bolt assembly 28 as it is moved into the bore hole 29 in the rock formation 16 has some degree of free movement to accommodate those instances where the bearing surface 62 of the truss shoe 27 and the roof 12 are not parallel to one another. The conversion from a circular hole to an elliptical hole is not limiting to the invention. In one non-limiting embodiment of the invention, the angle "A" is 45°, whereas opposite wall of the retention hole 76 lying along line 82 (see FIG. 4) and the bearing surface 62 subtend an angle "B" of 60°. Preferably, but not limiting to the invention, the interior wall portions of the retention hole 76 between the open ends 78 and 84 of the retention hole 76 of the truss shoe 27 are contoured to provide a seamless transition from the circular open end 78 to the elliptical open end 84 of the retention hole 76.

Figure 5:
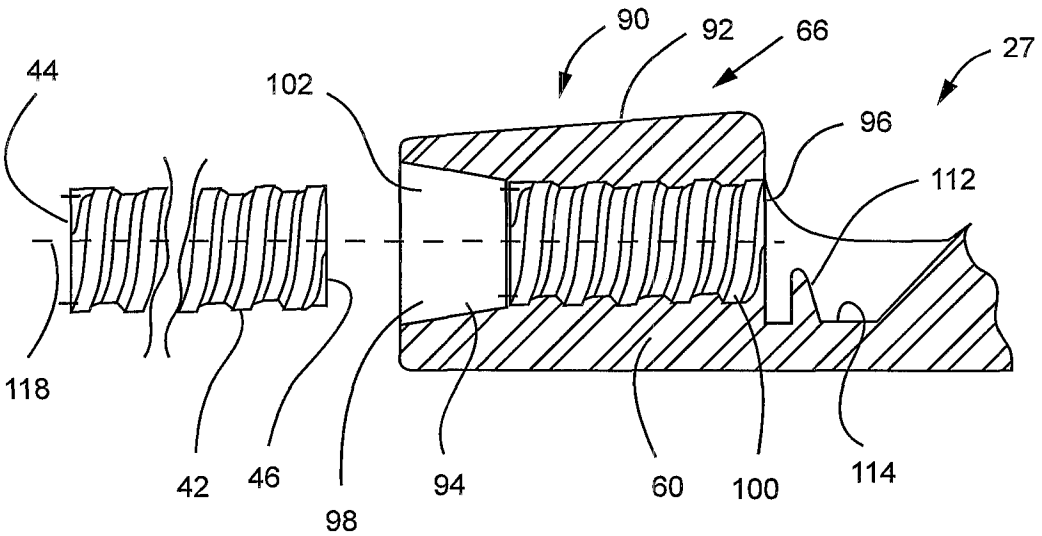
FIG. 5 is a fragmented cross-sectional view of the passageway of the truss shoe of the invention set to receive an end of a threaded rod.
Figure 6:
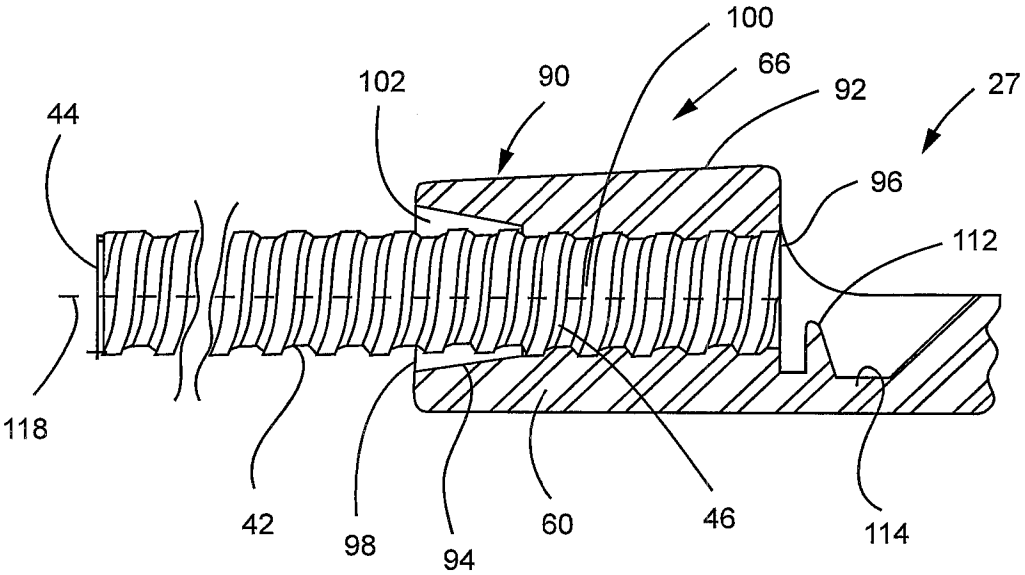
FIG. 6 is a view similar to the view of FIG. 5 showing the threaded rod in the threaded portion of the passageway of the truss shoe of the invention in accordance with the practice of the invention.

The threaded rod engaging section 66 of the truss shoe 27 includes a housing 90 extending upwardly or outwardly from the base 60 of the truss shoe 27. In one non-limiting embodiment of the invention, the housing 90 has a rounded outer upper surface 92 (clearly shown in FIG. 2) and a passageway 94 extending through the housing 90. The passageway 94 has a first open end 96 in facing relationship to, and spaced from, the circular open end 78 of the retention hole 76 of the truss shoe 27, and an opposite second open end 98. The passageway 94 has a threaded circular portion 100 and a cone-shaped surface portion 102. The threaded circular portion 100 extends from the first open end 96 toward the second open end 98 and terminates at a position 104 spaced from the second end 98. The threaded circular portion 100 has a constant threaded diameter from the end 96 to the position 104, and the diameter of the threaded portion 100 is sized to receive a threaded rod 108 (see FIG. 5). The diameter of the cone-shaped portion 102 increases as the distance from the position 104 in the passageway 94 in the direction of the second open end 98 of the passageway 94 increases. Preferably, but not limiting to the invention, the transition from the cone-shaped portion 102 to the threaded portion 100 at the position 104 is a seamless transition for ease of moving the end 44 of the threaded rod 42 from the cone-shaped portion 102 into the threaded portion 100 at the position 104 of the passageway 94 (see FIG. 7).

Figure 7:
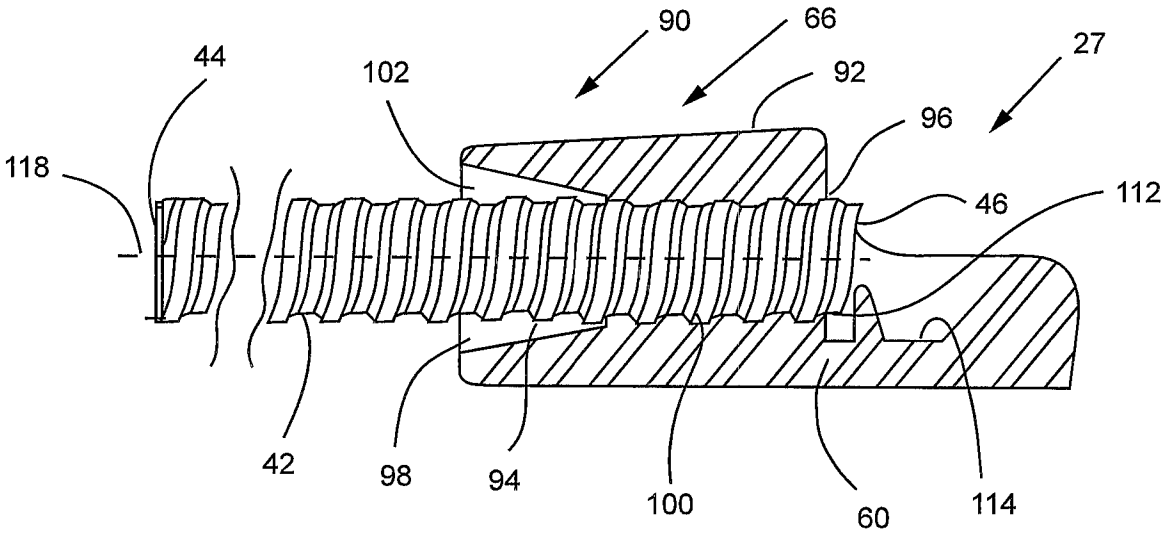
FIG. 7 is a view similar to the view of FIG. 5 showing the threaded rod in the passageway with the end of the threaded rod extending out of the passageway and engaging a stop member of the truss shoe of the invention in accordance with the practice of the invention.

With reference to FIGS. 2-7 as needed, a stop member or riser 112 extends upward from upper surface 114 of the base 60 between the retention hole 76 and the threaded rod engaging section 66, and is spaced from the open end 96 of the passageway 94. In this manner, the end 44 of the threaded rod 42 passes out of the first open end 96 of the passageway 94 and all of the threads of the threaded circular portion 100 of the passageway 94 are engaged by the threads of the threaded rod 42, as shown in FIG. 7. The distance between the stop member 112 and the open end 96 of the passageway 94 is not limiting to the invention and should be a sufficient distance for all of the threads of the threaded portion 100 of the passageway 94 to engage the threads of the threaded rod 108.

As is appreciated by those skilled in the art, the invention is not limited to the dimensions of the passageway 94 and the height of the riser 112. In one non-limiting embodiment of the invention, the length of the threaded portion 100 of the passageway 94 was 2.37 inches, and the length of the cone-shaped portion 102 was 1 inch. The passageway 94 at the position 104 had a diameter of 1.148 inches, at the first open end 96 a diameter of 1.148 inches, and at the second end 98 a diameter of 0.995 inch. The threads of the threaded portion 100 of the passageway 94 is not limiting to the invention and are sized to received the threaded bar, and the riser 112 had a height of 0.875 inch as measured from the bearing surface 62 of the truss shoe 27, and a centerline 118 of the threaded portion 100 of the passageway 94 is spaced 1.14 inches from the bearing surface 62 of the truss shoe 27.

In the preferred embodiment of the invention, the truss shoe 27 having the base 60, the bolt receiving section 64, the intermediate body section 68, and the threaded rod engaging section 66 is a formed, one-piece truss shoe 27 (see FIG. 2). The invention is not limited to the manner in which the truss shoe 27 is formed, e.g. and not limiting to the invention, the truss shoe of the invention can be cast or machined. The invention further contemplates individually forming the base 60, the bolt receiving section 64, the cable engaging section 66, and the intermediate section 68, and thereafter securing the sections on the base 60 using adhesives and/or mechanical securing arrangements, e.g., nails, screws, nuts, and bolts. Further, as can be appreciated, the invention is not limited to a particular type of material to make the truss shoes, however, the material selected should provide sufficient structural stability to provide the roof support required and to meet all safety standards. In the preferred practice of the invention, the truss shoe is made of metal, e.g., steel.

As can be appreciated, the invention is not limited to the dimensions of the truss shoe 27 of the invention, and the truss shoe should be large enough to provide a bearing surface 62 having an area sufficient to span recesses in the roof 12 (see FIG. 1). More particularly, in many underground passageways or excavations, the surface of the roof 12 can be very uneven or exhibit severely potted areas formed during the excavation operation. Therefore, it is recommended that the truss shoe 27 have a bearing surface 62 of a sufficient area (e.g., at least 36 square inches (232 square centimeters) and/or 4 inches (10.2 centimeters) by 10 inches (25.4 centimeters)) to prevent the bearing surface 62 from becoming distorted or pulled into a recess in the roof 12 when the roof bolt 31 is tensioned. While the truss shoe 27 is shown in FIG. 1 with the bearing surface 62 in a substantially horizontal position, it is appreciated by those skilled in the art that it is not uncommon for the truss shoe 27 to be substantially inclined or displaced from the preferred horizontal position.

With reference to FIGS. 2 and 3, an end 160 of the base 60 adjacent the second open end 98 of the passageway 94 is rounded for ease of moving the truss shoe 27 about the roof bolt assembly 28 (see FIG. 1), e.g., not engaging the roof 12 of the passageway 14 when the roof has a slope toward the floor 26. The base 60 has one side, e.g., side 162, longer than opposite side, e.g., opposite side 164, to provide an end 166 of the base 60 adjacent the bolt receiving section 64 with an arcuate edge or a sweeping radius as clearly shown in FIGS. 2 and 3. The side 164 of the truss shoe 27 is beveled as shown in FIG. 3. The sweeping radius at the end 166, the beveled side 164, and the rounded end 160 assist in moving the truss shoe 27 into the installation position. Optionally the truss shoe 27 can be provided with hanger holes 170 (only one shown and only shown in FIG. 2) for hanging accessory equipment, e.g., electric cables, lights, and conduits to the truss shoes.

In general, the truss system 10 using the truss shoe 27 of the invention is assembled in any convenient manner. For example but not limiting to the invention, the elongated roof bolt assemblies 28 are mounted in the roof 12 as discussed above, and the truss shoe 27 is secured on the roof bolt 31 by passing the roof bolt 31 through the retention hole 76 of the truss shoe 27 and securing the enlarged head 33 and washer 36 on the end of the bolt 31 as discussed above (see FIG. 1). The end 48 of the threaded bar 42 (see FIGS. 5-7) is moved though the second open end 98 of the passageway 94 and threaded into the threaded portion 100 of the passageway 94 (see FIG. 6) to move the end 48 of the threaded rod 42 into engagement with the stop member 112 (see FIG. 7).

The opposite ends 44 of the threaded bars 42 are joined to the coupler 46 (see FIG. 1), and the enlarged head 33 is moved along the roof bolt 31 to secure the bearing surface 62 of the truss shoe 27 against the ceiling 12. Thereafter, the coupler 46 is moved along the threaded bars 42 to place the threaded bars in tension.

It will be understood by those skilled in the art that while the foregoing description set forth in the detailed non-limiting preferred embodiments of the present invention, modifications, additions, and changes can be made thereto without departing from the spirit and scope of the invention as set forth in the following claims.

What is claimed is:

1. A method of securing a threaded rod in a truss shoe of a mine roof support assembly, comprising:

providing a truss shoe comprising a one-piece body member comprising a base member having a bearing surface, an opposite surface having a bolt receiving section, a housing spaced from the bolt receiving section and a stop member; the bolt receiving section having a retention hole; the housing having a passageway, the passageway having a first open end facing the bolt receiving section, an opposite second open end and a threaded portion extending from the first open end of the passageway toward the second open end, and the stop member positioned between the bolt receiving section and the housing, and spaced from the first open end of the passageway; and moving the threaded rod through the second open end of the passageway to move the first end of the threaded rod through the threaded portion of the passageway, out of the first open end of the passageway and through the space between the first open end of the passageway and the stop member into engagement with the stop member, wherein all of the threads of the threaded portion of the passageway are in facing relationship to a continuous selected portion of the threads of the threaded bar.

2. The method according to claim 1, further comprising passing a roof bolt assembly through the bore hole of the truss shoe, and securing the bolt assembly and truss shoe to a mine roof.

3. A truss shoe for use in a mine roof support system, the truss shoe comprising:

a one-piece body member, comprising:

a base member having a bearing surface;

an opposite surface having a bolt receiving section, the bolt receiving section having a retention hole;

a housing spaced from the bolt receiving section, the housing having a passageway, the passageway having a first open end facing the bolt receiving section, an opposite second open end and a threaded portion extending from the first open end of the passageway toward the second open end; and a stop member, the stop member positioned between the bolt receiving section and the housing, and spaced from the first open end of the passageway, whereby moving the threaded rod through the second open end of the passageway moves the first end of the threaded rod through the threaded portion of the passageway, out of the first open end of the passageway and through the space between the first open end of the passageway and the stop member into engagement with the stop member.

4. The truss shoe according to claim 3, wherein the passageway comprises a cone-shaped portion adjacent the second end of the passageway, wherein diameter of the cone-shaped portion decreases as the distance from the second end of the passageway increases.

5. The truss shoe according to claim 3, wherein the stop member has a major surface facing the first end of the passageway and the spaced distance of the first major surface of the stop member from the first end of the passageway, such that all of the threads of the passageway are engaged by the threaded rod.

6. The truss shoe according to claim 3, wherein the bore hole of the bolt receiving section has a first end opening at the bearing surface that is non-circular and an opposite second end opening that is circular, wherein (1) the second end opening of the bore hole of the bolt receiving section has a decreasing radius from the second end opening of the bore hole to a position within the bore hole spaced a predetermined distance from the second opening of the bore hole, and (2) a wall portion of the bore hole lies on a line extending from the first end of the bore hole to the second end of the bore hole defined as a first line, wherein the first line and a plane containing the bearing surface subtend a predetermined angle, and a wall portion of the bore hole lies on a line extending from the first end of the bore hole to the second end of the bore hole defined as a second line, wherein the first line and the second line are opposite one another, and the second line and a plane containing the bearing surface subtend an angle less than the predetermined angle.

7. A truss shoe for use in a mine roof support system, the truss shoe comprising:

a one-piece body member, comprising:

a base member comprising a bearing surface for engaging a mine roof; a bolt receiving section extending upward from the base member, the bolt receiving section comprising a bore hole extending through the bolt receiving section and the base member, wherein the bore hole of the bolt receiving section has a first end opening at the bearing surface that is non-circular and an opposite second end opening that is circular; and a threaded passageway for engaging a threaded member, the threaded passageway spaced from the bolt receiving section, and an intermediate section between the bolt receiving section and a cable engaging section, the intermediate section comprising a pair of spaced ribs between and interconnecting the bolt receiving section and the cable engaging section, and a groove between the ribs, the groove extending from the first open end of the passageway toward the bolt receiving section and a stop member, the stop member positioned in the groove between the bolt receiving section and the housing, and spaced from the first open end of the passageway.

8. The truss shoe according to claim 7, whereby moving the threaded member through the second open end of the passageway moves the first end of the threaded member through the threaded portion of the passageway, out of the first open end of the passageway and through the space between the first open end of the passageway and the stop member into engagement with the stop member.

9. The truss shoe according to claim 7, wherein the base member comprises an arcuate end adjacent the bore receiving section.

10. The truss shoe according to claim 9, wherein the base member comprises a first major surface and an opposite second major surface, a first side and an opposite second side, with the first side longer than the second side, and a first end joining the first side and the second side, the first end having a curved peripheral surface and an opposite second end joining the first and the second sides, and wherein the first major surface of the first end is larger than the second major surface of the second end, and peripheral edge of the first end is curved to provide a sweeping radius.

11. The truss shoe according to claim 10, wherein the pair of ribs comprise a first rib and a second rib, the first rib comprising a bottom portion and a top portion; the bottom portion having an end extending and connected to the cable receiving section, and an opposite end extending and connected to the bolt receiving section; the bottom portion of the first rib extending to an adjacent side of the base of the truss shoe; sloping sides extending between the bottom and the top portions; the top portion extending between and connected to the cable receiving section and the bolt receiving section, and ending short of the cut out, and the second rib comprising a bottom portion and a top portion; the bottom portion of the second rib having an end extending and connected to the cable receiving section, and an opposite end extending and connected to the bolt receiving section; the bottom portion of the second rib extending to a side of the base of the truss shoe adjacent to the second rib; sloping sides extending between the bottom and the top portions of the second rib; the top portion of the second rib extending between and connected to the cable receiving section and the bolt receiving section, and ending short of the cut out.

* * * * *